US008528807B2

(12) United States Patent
Kaneko

(10) Patent No.: US 8,528,807 B2
(45) Date of Patent: Sep. 10, 2013

(54) PACKAGING CONTAINER, AND POURING PLUG FITTED THERETO

(75) Inventor: Masamichi Kaneko, Tokyo (JP)

(73) Assignee: Tetra Laval Holdings & Finance S.A., Pully (CH)

( * ) Notice: Subject to any disclaimer, the term of this patent is extended or adjusted under 35 U.S.C. 154(b) by 140 days.

(21) Appl. No.: 13/089,950

(22) Filed: Apr. 19, 2011

(65) Prior Publication Data

US 2011/0192118 A1 Aug. 11, 2011

Related U.S. Application Data

(62) Division of application No. 10/542,863, filed as application No. PCT/JP03/15129 on Nov. 27, 2003, now Pat. No. 7,934,637.

(30) Foreign Application Priority Data

Jan. 24, 2003 (JP) ..... 2003-16360

(51) Int. Cl.

| | |
|---|---|
| ***B65B 3/02*** | (2006.01) |
| ***B65B 5/02*** | (2006.01) |
| ***B65B 7/00*** | (2006.01) |
| ***B65D 43/00*** | (2006.01) |
| ***B65D 5/74*** | (2006.01) |

(52) U.S. Cl.
USPC ..... 229/125.14; 53/458

(58) Field of Classification Search
USPC ..... 229/125.14, 125.15, 125.42, 204; 220/278
See application file for complete search history.

(56) References Cited

U.S. PATENT DOCUMENTS

| | | | | |
|---|---|---|---|---|
| 2,400,716 | A * | 5/1946 | Sattler | 222/107 |
| 5,088,643 | A | 2/1992 | Frazier et al. | |
| 5,176,313 | A | 1/1993 | Curry et al. | |
| 5,564,622 | A | 10/1996 | Wald | |
| 5,636,785 | A | 6/1997 | Kalberer et al. | |
| 6,131,806 | A | 10/2000 | Hess, III et al. | |
| 6,253,994 | B1 | 7/2001 | Mogard | |
| 6,279,779 | B1 | 8/2001 | Laciacera et al. | |
| 6,929,171 | B1 * | 8/2005 | Thiersch | 229/125.15 |
| 7,017,796 | B2 * | 3/2006 | Ishikawa | 229/125.15 |
| 2004/0011688 | A1 | 1/2004 | Ishikawa | |
| 2004/0169066 | A1 | 9/2004 | Palm | |

FOREIGN PATENT DOCUMENTS

| | | | |
|---|---|---|---|
| JP | 62-25623 | U | 2/1987 |
| JP | 1-40833 | Y2 | 12/1989 |
| JP | 11-091792 | A | 4/1999 |
| JP | 11-236027 | A | 8/1999 |
| JP | 2001-072008 | A | 3/2001 |
| JP | 2004-018024 | | 1/2004 |
| WO | WO 02/10020 | A | 2/2002 |

* cited by examiner

*Primary Examiner* — Gary Elkins
*Assistant Examiner* — Christopher Demeree
(74) *Attorney, Agent, or Firm* — Buchanan Ingersoll & Rooney PC

(57) ABSTRACT

A packaging container capable of reducing a tensile or compressive stress in the paper container caused by folding the pleat portion thereof to maintain the strength characteristics thereof, and providing a wide roof portion on one side thereof so that a large-sized spout can be fitted thereto. The packaging container including a pouring spout fitted thereto is characterized in that the top part thereof formed by folding the pleat line is formed of a surface tilted forward on the front side of the top part and a substantially flat surface adjacent to the tilted surface on the rear side of the top part and that a flap derived from the formation of the top part is allowed to abut on the container side-walls adjacent to the top part by the folding of the pleat.

9 Claims, 9 Drawing Sheets

PACKAGING CONTAINER, AND POURING PLUG FITTED THERETO

CROSS-REFERENCE TO RELATED APPLICATIONS

This application is a divisional of U.S. application Ser. No. 10/542,863 filed on Jun. 16, 2006, which is a U.S. national stage application of International Application No. PCT/JP2003/015129 filed on Nov. 27, 2003 and which claims priority to Japanese Application No. 2003-16360 filed on Jan. 24, 2003, the entire contents of all three of which is incorporated herein by reference.

TECHNICAL FIELD

The present invention relates to a packaging container, having a surface tilted forward on the front side of the top part, having APLH (Area for pre-laminated hole, hereinafter referred to as "APLH") on the tilted surface and a pouring plug fitted onto the container having the tilted surface.

BACKGROUND ART

Many of fluid foods such as fruit juice, UHT (ultrahigh treatment) milk, wine, tomato sauce or the like are dispensed with packed in packaging containers for fluid foods, which are made of aseptic package materials.

Typical examples of packaging containers for such fluid foods, are well-known parallelepiped (brick shape) paper containers and roof-shaped paper containers for liquid foods or fluid foods. These paper containers are formed by folding and sealing laminated packaging materials. This packaging material has a multilayer structure including a layer of fiber material, for example paper, coated on either side with heat-sealing plastic material such as polyethylene. Also, in the case of an aseptic paper container for long storage such as with UHT milk, the packaging material includes a layer of oxygen barrier material, for example defined by aluminum foil, which is superposed on the layer of heat-sealing plastic material, and additionally overlaid with a layer of other heat-sealing plastic material forming the inner surface of the packaging, contacting finally with the foods.

The packaging container, in the above described form, for fluid foods generally comprises a pluggable opening device in order to pour the liquid content out. Such an opening device substantially includes a hole forming an opening in a container wall, a frame fitted to a perforation or a cutting-off portion, and a cap.

An outstanding method fitting the opening device directly to a pre-laminated hole where the laminate film is attached to the perforation in the container wall and the packaging container fitted the opening device thereto are described in, for example, Japanese Patent Laid-Open No. 2001-72008.

The brick-shaped (parallelepiped) packaging container is formed into a final shape container 14 of brick shape illustrated for example in FIG. 8 by the following steps, i.e., in a filling machine illustrated for example in FIGS, forming a roll of the web-shaped packaging material 1 with pleat lines, made of fibrous substrate (for example, paper etc.)/plastics laminate, adhering a sealing tape on one end in the longitudinal direction by a applicator 3, forming the material into a tube shape by a forming roll 6 and a longitudinal line sealing unit 8, filling the content in the packaging material formed in a tube shape through a filling pipe 7, transversely sealing the tube-shaped packaging material in the transverse direction by a transverse sealing unit 10, 11, cutting the material at fixed spacing at an individual container, forming a primary shape container 13 with a cushion form or a pillow form, and folding flaps along the pleat lines by a final forming unit 15.

As illustrated in FIG. 6, a packaging material 1 for one container of the web-shaped container material with pleat lines comprises a longitudinal sealing region 26 for longitudinal sealing, a transverse sealing region 23 sealing the tube-shaped packaging material in the transverse direction, a side panel 21 forming a container wall, panels 20*a*, 22*a* forming the top part of the container, panels 20*b*, 22*b* forming the base part of the container, and panels forming a flap 24 adhered to the side wall or the base part by being folded wherein pleat lines such as 24*a*, 25*a*, 25*c* are formed at the boundary of these panels.

FIGS. 7 (*a*) (*b*) (*c*) illustrate appearances in which the primary shape container 13 is folded along pleat line, formed into the final shape container 14 of the brick shape as shown in FIG. 8, by folding the flap 24. (a) The primary shape container 13 having the front container wall 22, the side-wall 21, the rear container wall 20, the container wall 22*a* corresponding to the top part, the container wall 22*b*, 20*b* corresponding to the bottom part, the transverse sealing part 23 and the longitudinal sealing part 26 is formed. (b) Then, it is folded along pleat line and folding edges (flaps) 24, 25 and a fin 23 for transverse seal are protruded. (c) Finally, the fin 23 for transverse seal is folded, the flap 24 is adhered to the side container wall 21 along the pleat line 24*a*, the flap 25 is adhered to the bottom container wall along the pleat line 25*c*.

In roof-shaped paper packaging containers, the paper packaging material is cut into a predetermined shape, blanks sealed in the container lengthwise direction are formed, after the bottom of the blanks is sealed in a filling machine, cows milk, juice, or other drinks are packed from a top opening, the upper part is sealed, and the product container is obtained. In such packaging materials, the appearance design of a packaging container product is printed on the surface.

As for the roof-shaped paper packaging container, a paper container of which large-sized spout is fitted on a wide roof portion on one side thereof is proposed. (Japanese Patent Laid-Open Nos. 1999-91792 and 1999-236027 etc.)

However, when a shed roof shape of one roof is formed from the roof shape (gable shape) by folding the top seal fin, folding portions are further excessively folded inward, it causes an increase of a tensile or compression stress, thus remarkably reduces the strength characteristics of the paper container.

To the contrary, in a paper container obtained from the web-shaped packaging material described above, a paper container which is not a brick shape, where a folding piece formed by shaping the top part is folded onto a side wall surface, and the top part is formed into a shed roof shape, is proposed. (International Patent Publication WO02/10020).

This enables the paper container to maintain strength characteristics thereof by reducing the tensile or compressive stress and to fit a large-sized spout and a cap to the top part.

There is a difficulty in fitting a large-sized spout to brick-shaped (parallelepiped) packaging containers.

On the other hand, as for roof-shaped paper packaging containers, in the above described container having the tilted surface on the above described conventional top part, a large-sized spout can be fitted to the one side with a wide roof portion. However, when a shed roof shape of one roof is formed from the gable shape by folding the top seal fin, folding portions are further excessively folded inward, it causes an increase of a tensile or compression stress, thus remarkably reduces the strength characteristics of the paper container.

In paper containers of which top part is formed in a shed roof shape, a folding piece (flap) formed by shaping the top part is folded onto the side wall, the tip portion of the top part protrudes at a sharp edge, thus the portion is subject to much of the mechanical stress through manufacturing process, distribution process, and consumption process.

In addition, a conventional pouring plug provided in the above described container having the tilted surface on the top part has a structure in which a bottom portion of a cap adhered to APLH (Area for pre-laminated hole) is pulled up while rotating to form an opening when the cap is opened along the thread from the pouring spout by twisting APLH off. There is, however, a disadvantage that a portion of the lower layer happens to remain on the container side, while only the upper layer adhered to the cap is torn off, if the adhesion between each layer is not sufficient due to the multilayer structure of APLF of the laminate.

Further, there may incur a disadvantage in that fibrous dross remains on the cutting (fractured) surface because a plurality of polyolefin layers consisting of APLH laminate elongates by APLH being twisted off.

Furthermore, air gaps are easily generated in the section of the hole forming an opening of the container wall and in the section of the perforation. Therefore, there is a necessity to reduce a risk that the liquid content penetrates into the section of the container wall when cutting APLH laminate of the proximity to the air gaps.

DISCLOSURE OF THE INVENTION

It is an object of the present invention is to provide a packaging container capable of reducing a tensile or compressive stress caused by folding portions to be folded in the paper container to maintain strength characteristics thereof, and fitting a large-sized spout thereto with a wide roof portion on one side of the container.

It is a further object of the present invention is to provide a large-sized spout provided on the tilted surface of the top part of the container, which can form a neat opening part without leaving a portion of the laminate film of APLH when opening or without providing a consumer with uncomfortable feeling.

It is still a further object of the present invention is to provide a large-sized spout provided on the tilted surface of the top part of the container, which is capable of reducing a risk that the liquid content penetrates into the section of container.

The packaging container of the present invention attaining these objects and the pouring spout fitted to the packaging container are characterized in that the top part formed by folding the pleat line has a surface tilted forward on the front side of the top part and a substantially flat surface adjacent to the tilted surface on the rear side of the top part and that a flap derived from the formation of the top part is allowed to abut on the container side-walls adjacent to the top part by the folding of the pleat line.

The pouring spout fitted to the packaging container of the present invention, having a surface tilted forward on the front side of the top part, comprising a frame body, a cap and a movable ring fitted to the packaging container having APLH sealed by film on the tilted surface is characterized in that the frame body comprises a flange connected with the tilted surface of the circumference of APLH and a pouring spout portion of a cylindrical shape integrally moulded with the flange and cut approximately at an angle so as to be upright substantially, wherein a cap is fitted removably to the pouring spout portion so as to plug the pouring spout and a movable ring, disposed at the inner circumference of the pouring spout, with the cylindrical shape cut approximately at an angle at the lower end portion thereof, is engaged with the cap so as to rotate concurrently with the rotation of the cap, having a cutting part at the lower end portion of a shape cut approximately at an angle or the proximity thereto.

This structure enables the paper container to maintain the strength characteristics thereof with reduced a tensile or compressive stress in the paper container caused by folding the pleat portion thereof and to fit a large-sized spout thereto with providing a wide roof portion on one side thereof.

As for the large-sized spout of the present invention fitted to the tilted surface of the top part of the container, a neat opening can be formed without leaving a portion of the laminate film in APLH when opening or without providing consumers with uncomfortable feeling.

As for the large-sized spout of the present invention fitted onto the top part of the container, it is possible to reduce a risk that the liquid content penetrates into the section of the container wall.

The packaging container of the present invention described in Claim 1 is characterized in that the packaging container of the final shape can be obtained by forming web shape packaging material having pleat lines into a tube shape, longitudinally sealing the tube shape packaging material along the longitudinal direction at the both ends of said packaging material, filling fluid foods into the tube-shaped packaging material, transversely sealing the tube-shaped packaging material in the transverse direction, forming a pillow shape container by cutting at said transverse seal portion, and folding a flap along the pleat line, wherein a top part thereof formed by folding said pleat line has a surface tilted forward on the front side of said top part and a substantially flat surface adjacent to said tilted surface on the rear side of said top part and that said flap derived from the formation of said top part is allowed to abut on said container side-walls adjacent to said top part by the folding of said pleat. The above described structure enables the paper container to reduce a tensile or compressive stress in the paper container caused by folding the pleat portion, thus to fold the container naturally. As a result, maintaining the strength characteristics of the container enables the prevention of the occurrence of a breakage, a check and a crack or the like in the local portion of the container. Providing a wide roof portion on one side thereof allows a large-sized spout of the present invention to be fitted thereto.

Having a substantially flat surface adjacent to the tilted surface on the rear side of the top part allows the container to be easily stacked, after forming the container, in storage, stock, distribution, store display and preservation in the domestic refrigerator.

A pouring plug fitted to the packaging container described in Claim 2 of the present invention is characterized in that the pouring plug comprises a frame body, a cap and a movable ring fitted to the packaging container having a surface tilted at least forward on the front side of the top part and APLH sealed by film on said tilted surface, wherein the frame body forming the pouring spout comprises a flange connected with said tilted surface of the circumference of said APLH, and a spout portion of a cylindrical shape integrally moulded with the flange and cut approximately at an angle so as to be upright substantially, said cap is fitted removablely to said pouring spout portion so as to plug said pouring spout, and said movable ring, disposed at the inner circumference of said pouring spout, with the cylindrical shape cut approximately at an angle at the lower end portion thereof is engaged with said cap so as to rotate concurrently with the rotation of said cap having a cutting part at the lower end portion of a shape cut approximately at an angle or the proximity thereto.

The above described structure allows the pouring spout to have a cylindrical shape cut approximately at an angle and also the movable ring installed in the pouring spout to have the lower end portion thereof cut approximately at an angle. The movable ring engages with the cap, rotating concurrently with the rotation of the cap and an edge of the cutting part disposed at the lower end portion or the proximity thereof cuts the laminate film of APLH when opening.

Thus by rotating continuously, the structure of this invention enables the cutting part to cut APLH in the aslant condition against APLH of the packaging container. This results in forming a sharp cutting surface without any undulations, protrusions and residual dross. A neat opening portion is allowed to be formed without leaving a portion of the laminate film in APLH around the opening of the container when opening or without providing consumers with uncomfortable feeling.

Substantially, since the portion touched by the cutting part is cut, even air gaps on the edge of APLH, not expected to be broken, are never broken off. Thus this structure works to reduce a risk that the liquid content may penetrate into the section of the container wall.

The pouring plug of the present invention described in Claim 3 is fitted to the packaging container having the substantially flat surface adjacent to said tilted surface on the rear side of said top part and the height of said cap fitted to said pouring spout portion is lower than that of said flat portion of the top port of said container.

The above described structure prevents the movable ring from protruding the top part of the container and works to enable the container to be easily stacked, by the flat surface on the rear side of the top part, after forming the container, in storage, stock, distribution, store display and preservation in the domestic refrigerator.

In the pouring plug of this invention described in Claim 4, the movable ring is provided with a guide groove in the inner circumference surface of the pouring spout part and a guide boss in the outer circumference surface of the movable ring so that the movable ring moves vertically when rotating with the rotation of the cap, and the position of the guide groove when completing the rotation is lower than that of the guide groove when starting the rotation.

The above described structure enables the movable ring to move vertically, ensuring that the cutting part cuts APLH of the packaging container. Moreover, since the position of the guide groove when completing the rotation is lower than that of the guide groove when starting the rotation, the movable ring which became unnecessary when finishing the process of cutting a seal, hides down below the pouring spout, thus the structure works for covering the cut end of APLH.

In the pouring plug of this invention described in Claim 5, the position of the guide groove thereof when the completion of the rotation is set so that the movable ring can rotate with the rotation of the cap to cut the sealed film of APLH in a circular shape with leaving a portion of the unbroken film.

The above described structure enables a portion of the sealed film of APLH to remain unbroken, thus working to prevent the broken film from falling into the inside of the container and the consumer from ingesting it accidentally.

The pouring plug of this invention described in Claim 6 has a rotation assist part protruding from the outer circumferential surface of the cap and a tamper-proof part righting against said flange part, prior to opening, said rotation assist part engaging with said tamper-proof part so as to be disengaged easily by means of the cap rotation.

The above described structure enables the cap to be easily rotated by the leverage of the protruding rotation assist part, thus working to prevent tampering or the like because the rotation enables the rotation assist part and the tamper-proof device to be disengaged easily with each other.

BEST MODE FOR CARRYING OUT THE INVENTION

Hereafter, the embodiments of the present invention will be described.

Figure 1:
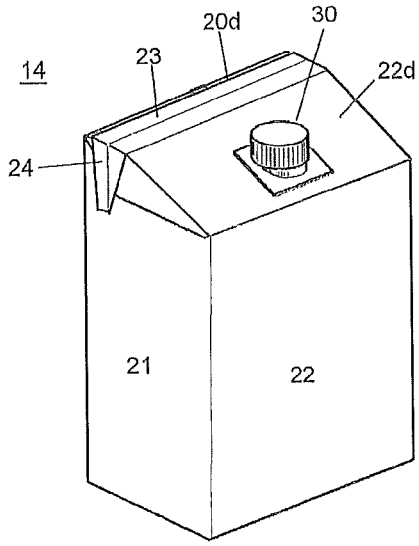
FIG. 1 is a perspective view of a packaging container in accordance with one embodiment of the present invention.
Figure 3:
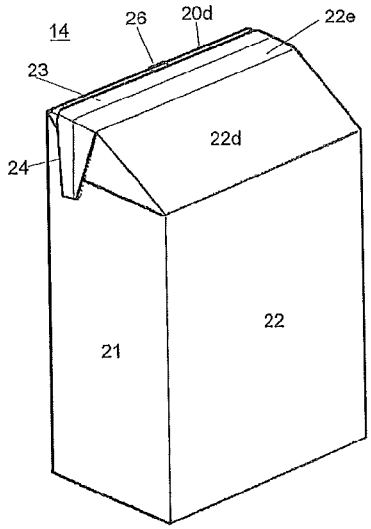
FIG. 3 is a perspective view of a packaging container in accordance with one embodiment of the present invention.
Figure 5:
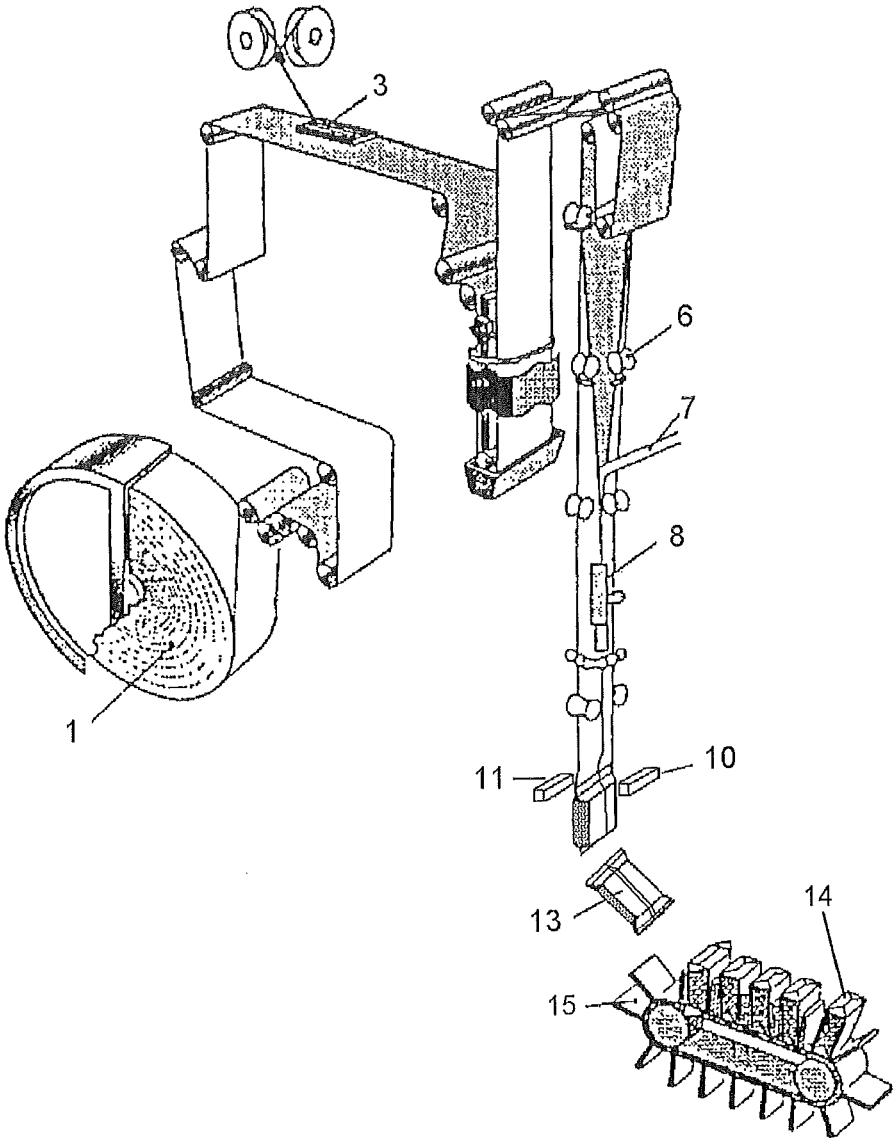
FIG. 5 is a schematic illustration of a filling machine to produce a packaging container in accordance with one embodiment of the present invention.
Figure 6:
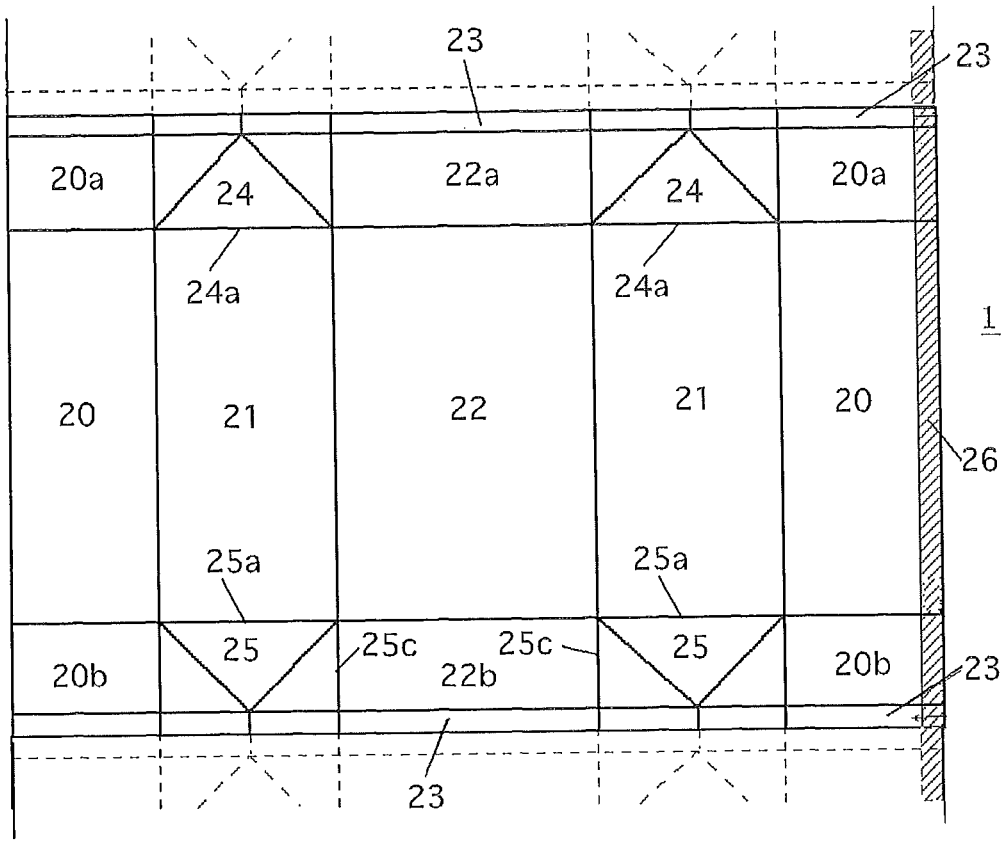
FIG. 6 is a plan view of a package material of a conventional packaging container.
Figure 7:
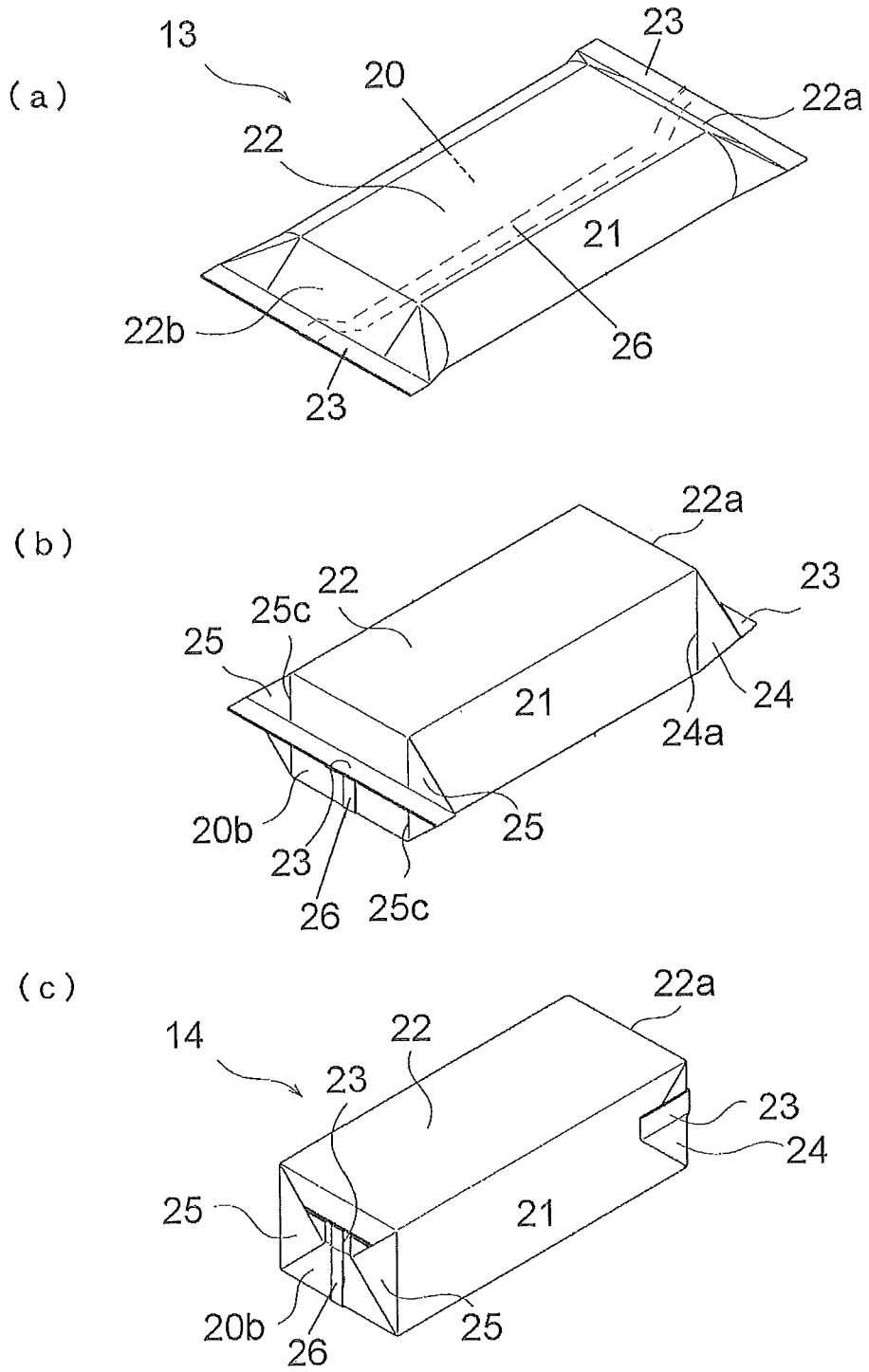
FIG. 7 is a perspective view of a formation of the conventional package container.
Figure 8:
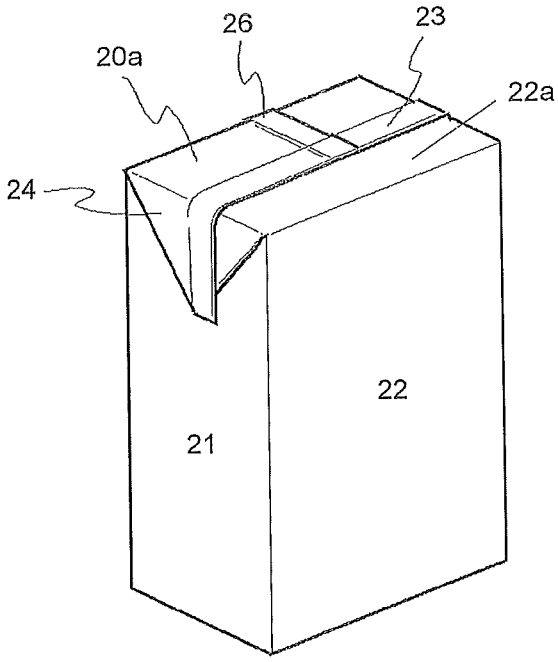
FIG. 8 is a perspective view of the conventional packaging container.

FIGS. 1 and 3 illustrate a perspective view of a packaging container in accordance with one embodiment of the present invention respectively. A packaging container 14 is a final shape of the packaging container 14, using a packaging filling machine as illustrated by FIG. 5, obtained by formation 6 of a web shape packaging material 1 having pleat lines into a tube shape, longitudinal sealing 8 of the tube shape packaging material along the longitudinal direction at the both ends thereof, filling 7 of fluid foods into the tube-shaped packaging material, transverse sealing 11,12 the tube-shaped packaging material in the transverse direction, formation 13 of a pillow shape container by cutting at the transverse seal portion, and folding 15 of a flap 24 along the pleat line.

A top part formed by folding a pleat line has a surface 22*d* tilted forward on the front side of the top part and a substantially flat surface (20*d*, 23, 22*e*) adjacent to the tilted surface 22*d* on the rear side of the top part and a flap 24 derived from the formation of the top part is allowed to abut on the container side-walls 21 adjacent to the top part by the folding of the pleat line.

FIG. 1 is an aspect of the embodiment having a pouring spout on the packaging container and FIG. 3 is an aspect of the embodiment having no pouring spout on the packaging container.

As illustrated in FIG. 1, the aspect having the pouring spout of the packaging container involves a pouring plug 30 in accordance with one embodiment of the present invention.

Figure 4:
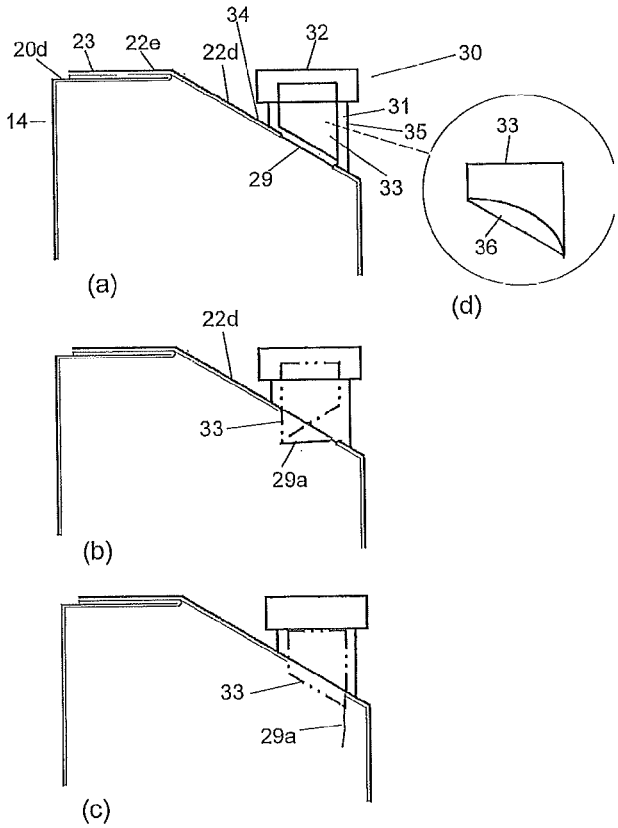
FIG. 4 is a section view of a packaging container in accordance with one embodiment of the present invention.

The pouring plug 30 of the embodiment illustrated in FIG. 1 and FIG. 4 showing the section view of the packaging container of the embodiment of FIG. 1 is the pouring plug 30 comprising a frame body 31, a cap 32, and a movable ring 33 fitted to the packaging container 14 having the surface 22*d* tilted forward on the front side of the top part and having APLH 29 (not illustrated in FIG. 1) sealed with a film on the tilted surface 22*d*.

A frame body 31 forming the pouring spout comprises a flange 34 connected with the tilted surface of the circumference of APLH 29 and a pouring spout portion 35 of a cylindrical shape, integrally moulded with the flange 34 and cut approximately at an angle so as to be upright substantially.

A cap 32 is removablely fitted to the pouring spout portion 35 so as to plug the pouring spout.

A movable ring 33, disposed at the inner circumference of the pouring spout 35, with the cylindrical shape cut approximately at an angle at the lower end portion thereof, is engaged with the cap 32 so as to rotate concurrently with the rotation of the cap 32, having a cutting part 36, as illustrated in FIG. 31(*d*), at the lower end portion of a shape cut approximately at an angle or the proximity thereto.

Figure 2:
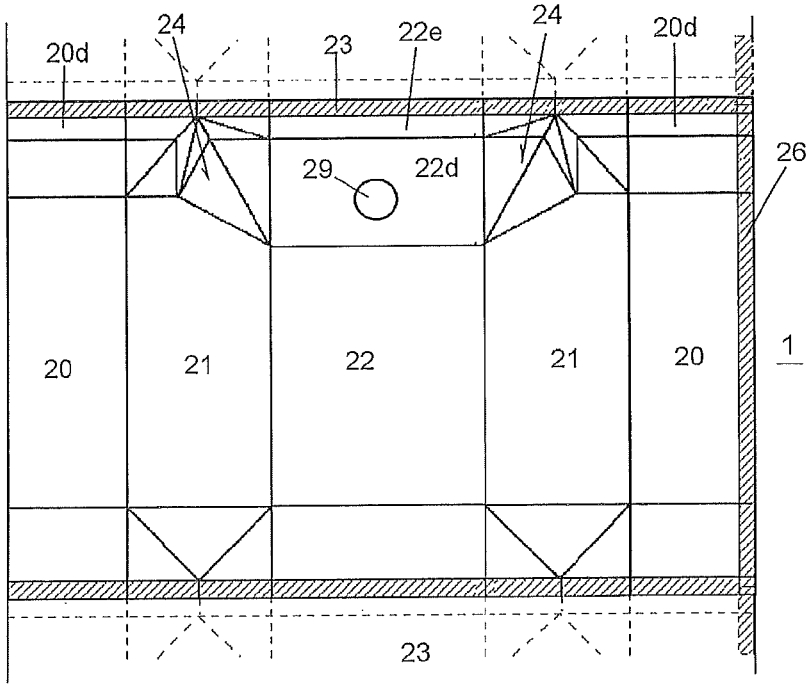
FIG. 2 is a plan view of a packaging material of the packaging container in accordance with one embodiment of the present invention.

FIG. 2 illustrates a packaging material for forming the container shown in FIG. 1. The packaging material 1 for one container of the web shape container material with pleat lines comprises a longitudinal seal region 26 for longitudinal sealing, a transverse seal region 23 sealing the tube-shaped packaging material in the transverse direction, side panel 21 forming a packaging walls, a panel 20*d* 22*d* 22*e* forming the top portion of the container, panels forming the base part of the container, and panels forming a flap 24 adhered to the sidewalls or the base part after folding, wherein pleat lines are formed at the boundary of these panels.

FIGS. 4 (*a*) (*b*) (*c*) illustrate a motion of the pouring plug 30.

The pouring spout 35 has the cylindrical shape cut approximately at an angle and the movable ring 33 fitted in the pouring spout is also allowed to comprise the lower end cut approximately at an angle. The movable ring 33 engages with the cap 32, rotating concurrently with the rotation of the cap 32 and an edge of the cutting part 36 disposed at lower end portion or the proximity thereof cuts the laminate film of APLH 29 at the time of opening. (FIG. 4(*a*) (*b*))

The cutting part 36 forms a sharp cutting surface cutting APLH 29, by rotating continuously, in the aslant condition against APLH 29 of the packaging container. As illustrated in FIG. 4(*b*), a film 29*a* in APLH 29 shifts downward.

This is because the position of the guide groove when completing the rotation of the movable ring is set so that the movable ring can rotate with the rotation of the cap to cut the sealed film of APLH in a circular shape with leaving a portion of the unbroken film.

This structure enables a portion of the sealed film of APLH to remain unbroken, and prevents the broken film form falling into the inside of the container and the consumer from ingesting it accidentally.

Figure 9:
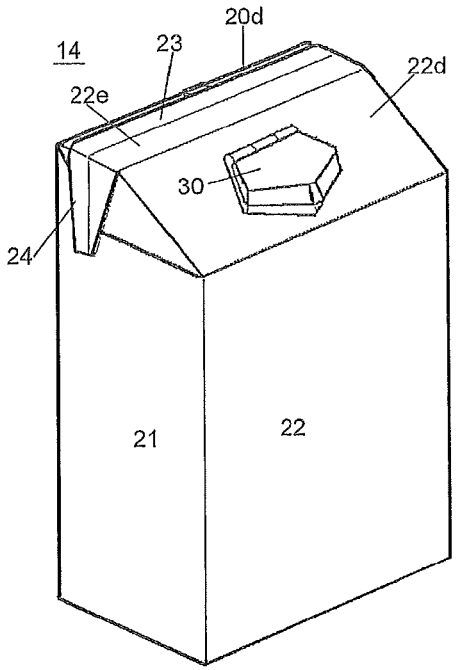
FIG. 9 of is a perspective view of a packaging container in accordance with one embodiment of the present invention.

FIG. 9 illustrates the perspective view of the packaging container having a pouring plug 30 in accordance with the one embodiment of the present invention. A packaging container 14 is also the final shape of the packaging container 14, using a packaging filling machine as illustrated by FIG. 5, obtained by formation 6 of a web shape packaging material 1 having pleat lines into a tube shape, longitudinal sealing 8 of the tube shape packaging material along the longitudinal direction at the both ends thereof, filling 7 of fluid foods into the tube-shaped packaging material, transverse sealing 11,12 of the tube-shaped packaging material in the transverse direction, formation 13 of a pillow shape container by cutting at the transverse seal portion, and folding 15 a flap 24 along the pleat line.

The top part formed by folding a pleat line has a surface 22*d* tilted forward on the front side of the top part, a substantially flat surface (20*d*, 23, 22*e*) adjacent to the tilted surface 22*d* on the rear side of the top part and a flap 24 derived from the formation of the top part is allowed to abut on the container side-walls 21 adjacent to the top part by the folding of the pleat line.

Figure 10:
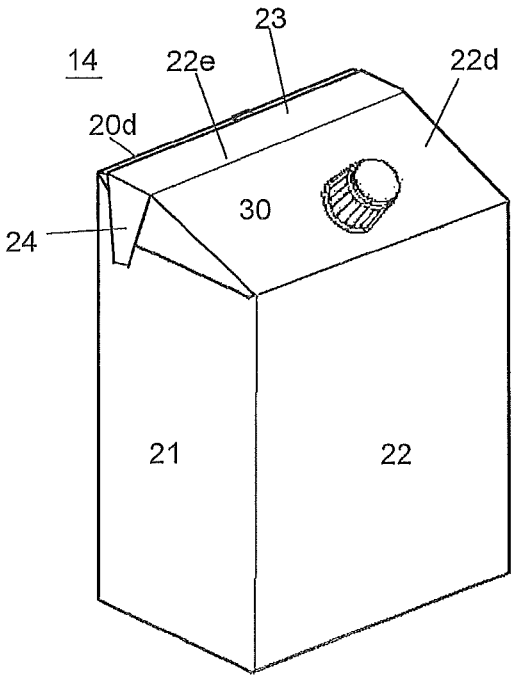
FIG. 10 is a perspective view of a packaging container in accordance with one embodiment of the present invention.

In addition, FIG. 10 illustrates the perspective view of the packaging container having a pouring plug 30 in accordance with the one embodiment of the present invention. For the packaging container 14, the top part formed by folding a pleat line has a surface 22*d* tilted forward on the front side of the top part and a substantially flat surface (20*d*, 23, 22*e*) adjacent to the tilted surface 22*d* on the rear side of the top part 22*a* and a flap 24 derived from the formation of the top part is allowed to abut on the container side-walls 21 adjacent to the top part by the folding of the pleat line.

Figure 11:
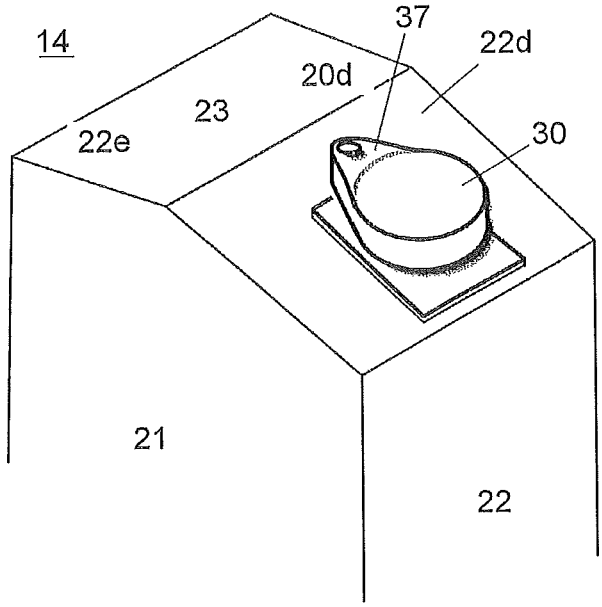
FIG. 11 is a perspective view of a packaging container in accordance with a preferable embodiment of the present invention.

FIG. 11 illustrates the perspective view of the packaging container having a pouring plug 30 in accordance with a preferable embodiment of the present invention. For the packaging container 14, the top part formed by folding a pleat line has a surface 22*d* tilted forward on the front side of the top part and a substantially flat surface (20*d*, 23, 22*e*) adjacent to the tilted surface 22*d* on the rear side of the top part and a flap 24 derived from the formation of the top part is allowed to abut on the container side-walls 21 adjacent to the top part by the folding of the pleat line.

The pouring plug 30 is fitted to the packaging container having the substantially flat surface adjacent to the tilted surface 22*d* on the rear side of the top part and the height of the cap fitted to the pouring spout portion is lower than that of the flat portion of the top part of the container. This prevents the pouring plug from protruding from the top part of the container and enables the container to be easily stacked by the flat surface of the rear side of the top part, after forming the container, in storage, stock, distribution, store display, and preservation in the domestic refrigerator.

Figure 12:
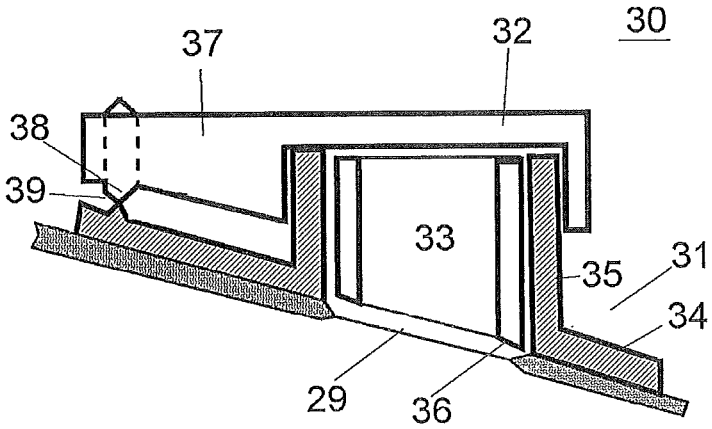
FIG. 12 is a section view of a pouring plug in accordance with a preferable embodiment of the present invention.

FIG. 12 illustrates the section of the pouring plug 30 in accordance with a preferable embodiment of the present invention. This pouring plug 30 comprises a frame body 31, a cap 32, and a movable ring 33.

The frame body 31 forming the pouring spout comprises a flange 34 connected with the tilted surface of the circumference of APLH 29 and the pouring spout portion 35 of the cylindrical shape integrally moulded with the flange 34 and cut approximately at an angle so as to be upright substantially.

The cap 32 is removablely fitted to the pouring spout portion 35 so as to plug the pouring spout.

The movable ring 33, disposed at the inner circumference of the pouring spout 35, with the cylindrical shape cut approximately at an angle at the lower end portion thereof is engaged with the cap 32 so as to rotate concurrently with the rotation of the cap 32, having the cutting part 36 at the lower end portion of the shape cut approximately at an angle or the proximity thereto.

The pouring plug 30 has a rotation assist part 37 protruding from the outer circumferential surface of the cap 32 and the tamper-proof part 38 righting against the flange 34, prior to opening, the rotation assist par 37 engaging 39 with the tamper-proof device 38 so as to be disengaged easily by means of the cap rotation.

This enables the cap to be easily rotated by the leverage of the protruding rotation assist part and prevents tampering or the like because the rotation enables the rotation assist part and the tamper-proof device to be disengaged easily with each other.

Figure 13:
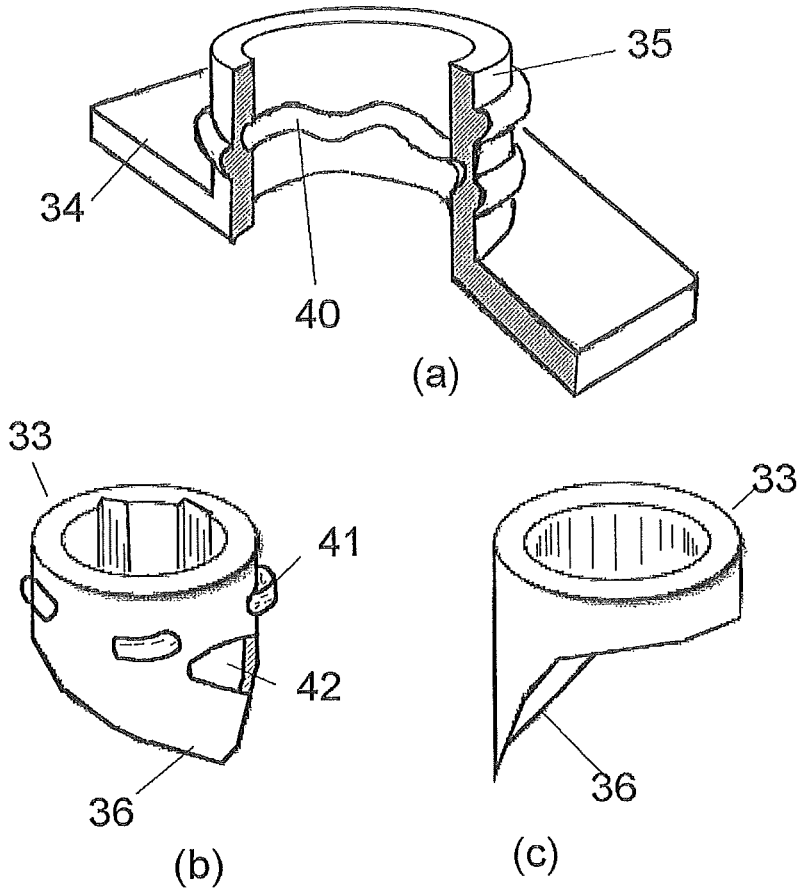
FIG. 13 is a partial perspective view of a pouring plug in accordance with a preferable embodiment of the present invention.

As illustrated in FIG. 13, the pouring plug 30 shown in FIG. 12, is provided with a guide groove 40 in the inner circumference surface of the pouring spout part 35 and a guide boss 41 in the outer circumference surface of the movable ring 33 so that the movable ring 33 moves vertically when rotating with the rotation of the cap, and the position of the guide groove 40 when completing the rotation is lower than that of the guide groove 40 when starting the rotation.

The vertical motion of the movable ring 33 ensures that the cutting part 36 cuts APLH 29 of the packaging container. Since the position of the guide groove 40, when completing the rotation, is lower than that of the guide groove 40, when starting the rotation, the movable ring 33 which became unnecessary when finishing the process of cutting a seal, as illustrated in FIG. 4(*c*), hides down below the pouring spout covering the cut end of APLH.

In this aspect, a through-hole 42 is disposed at a side wall of the movable ring 33 in order to make the pouring easy.

As described above, the present invention enables a packaging to maintain the strength characteristics thereof and to reduce a tensile or compressive stress in the paper container caused by folding the pleat portion thereof and to provide a wide roof portion on one side thereof so that a large-sized spout can be fitted thereto.

In the large-sized spout of the present invention fitted to the tilted surface of the top part of the container, a neat opening is allowed to be formed without leaving a portion of the laminate film in APLH when opening or without providing consumers with uncomfortable feeling.

In the large-sized spout of the present invention fitted onto the top part of the container, it is possible to reduce a risk that the liquid content may penetrates into the section of the container wall.

INDUSTRIAL APPLICABILITY

The packaging container and the pouring plug according to the present invention are employed for the packaging container which contains liquid foods such as milk and cold beverage or the like.

What is claimed is:

1. A packaging container having a final shape obtained by forming a web shape packaging material having pleat lines and longitudinal and lateral directions into a tube-shaped packaging material, longitudinally sealing the tube-shaped packaging material in the longitudinal direction of said packaging material, filling fluid food into the tube-shaped packaging material, transversely sealing the tube-shaped packaging material in the transverse direction to form a transverse sealed portion, forming a pillow shape container by cutting at said transverse sealed portion, and folding a flap along a pleat line to form a portion of a top part of the packaging container, wherein the top part has a tilted surface tilting forward on a front side of said top part and a substantially flat surface adjacent to said tilted surface on a rear side of said top part, and wherein said flap derived from the formation of said top part folds over the top part and extends beyond side edges of the top part and onto a surface area portion of side-walls of the packaging container adjacent to said top part by the folding of said pleat line, the top part having six corners, and not more than six corners, where the side-walls and front and rear walls of the packaging container meet the top part.

2. The packaging container according to claim 1, wherein the tilted surface of the top part of the packaging container has a greater surface area than the substantially flat surface of the top part.

3. The packaging container according to claim 1, further comprising a front wall between the side walls of the packaging container, the front wall having a greater surface area than each of the side walls.

4. A packaging container obtained by forming a web shape packaging material into a tube-shaped packaging material, longitudinally sealing the tube-shaped packaging material in a longitudinal direction of the packaging material, filling liquid food into the tube-shaped packaging material, transversely sealing the tube-shaped packaging material in a transverse direction to form transverse sealed portions, forming a pillow shape container with a flap by cutting at the transverse sealed portions, and folding the flap along a pleat line to form a portion of a top end of the packaging container, the packaging container in an upright position comprising:

a bottom end opposite the top end, two side panels extending vertically between the top end and the bottom end, a front panel extending vertically between the top end and the bottom end, and a rear panel extending vertically between the top end and the bottom end, the front panel and the rear panel being positioned opposite each other;

the flap being folded over on itself at the top end of the packaging container and also being folded over the top end and extends beyond side edges of the top end and contacts at least a surface area portion of the two side panels of the packaging container;

a substantially flat horizontal surface on a rear portion of the top end of the packaging container, the substantially flat horizontal surface on the rear portion of the top end of the packaging container intersecting the rear panel;

a tilted surface tilting forward at a front portion of the top end of the packaging container, the tilted surface intersecting the substantially flat horizontal surface and also intersecting the front panel; and the to end having six corners, and not more than six corners, where the two side panels and the front and rear panels meet the top end.

5. The packaging container according to claim 4, wherein the tilted surface of the top end of the packaging container has a greater surface area than the substantially flat horizontal surface of the top end.

6. The packaging container according to claim 4, wherein the front panel has a greater surface area than each of the two side panels.

7. A method of forming a packaging container, comprising:

forming a web shape packaging material into a tube-shaped packaging material;

longitudinally sealing the tube-shaped packaging material to produce a longitudinally sealed tube-shaped packaging material;

filling liquid foods into the longitudinally sealed tube-shaped packaging material to produce a liquid food-filled longitudinally sealed tube-shaped packaging material;

transversely sealing the liquid food-filled tube-shaped packaging material in the transverse direction to form a transverse sealed portion;

forming a liquid food-filled pillow-shaped container by cutting at the transverse sealed portions to produce a packaging container having a flap at one end;

folding the flap along a pleat line to form a portion of a top end of the packaging container so that the top end has a tilted surface tilting forward on a front side of the top end and a substantially horizontal surface adjacent to the tilted surface on a rear side of the top end, so that the to end has six corners, and not more than six corners, where oppositely disposed side panels and oppositely disposed front and rear panels of the packaging container meet the top end; and the folding of the flap also comprising folding the flap over the top end so that a portion of the flap extends beyond side edges of the top end and onto a surface area portion of the oppositely disposed side panels of the packaging container adjacent the top end.

8. The method according to claim 7, wherein the tilted surface of the top end of the packaging container is formed to have a greater surface area than the substantially horizontal surface of the top end.

9. The method according to claim 7, further comprising forming a front wall below the top end of the packaging container and between the oppositely disposed side panels, and the front wall has a greater surface area than each of the side panels.

* * * * *